US006047409A

United States Patent [19]

Simpson

[11] Patent Number: 6,047,409

[45] Date of Patent: Apr. 11, 2000

[54] ADJUSTABLE SAFETY LOCK FOR HELMET FACE SHIELD

[76] Inventor: Elwood J. B. Simpson, 185 Rolling Hill Rd., Moorseville, N.C. 28115

[21] Appl. No.: 09/071,850

[22] Filed: May 2, 1998

[51] Int. Cl.[7] ..... A42B 3/22

[52] U.S. Cl. ..... 2/424

[58] Field of Search ..... 2/6.5, 6.7, 424, 2/10, 410, 411

[56] References Cited

U.S. PATENT DOCUMENTS

| | | | |
|---|---|---|---|
| 4,242,757 | 1/1981 | Nava | 2/10 |
| 4,247,960 | 2/1981 | Nava | 2/424 |
| 4,312,078 | 1/1982 | Pollitt et al. | 2/424 |
| 4,615,052 | 10/1986 | Nava | 2/424 |
| 4,621,377 | 11/1986 | Pennell | 2/6 |

FOREIGN PATENT DOCUMENTS

| | | | |
|---|---|---|---|
| 223139 | 5/1987 | European Pat. Off. | 2/424 |
| 7611248 | 4/1977 | Netherlands | 2/424 |
| 8601694 | 3/1986 | WIPO | 2/424 |

*Primary Examiner*—Michael A. Neas
*Attorney, Agent, or Firm*—William H. Maxwell

[57] ABSTRACT

A face shield adjustment control and safety lock characterized by fore and aft horizontal shifting of the transparent shield to close and limitedly open for air circulation, by selectively limited lifting about the anchor pivot for increaed air circulation and for face access, embodied in an inserted spring plate with control slots and detents for controlling and positioning the shield.

17 Claims, 4 Drawing Sheets

H
16
X
S
26
45
46
51
43
53
A
44
42
30
b
8°
a
31
12
44
C
54
35

27
16
H
X
L
S
26
45
44
46

53
33°
A
44'
b
42
30
31
C
51
43
54
52
35
17
18

ADJUSTABLE SAFETY LOCK FOR HELMET FACE SHIELD

BACKGROUND OF THE INVENTION

This invention relates to protective helmets as used in the sports of vehicle racing, where high speeds result in damaging wind velocities. That is, high wind velocites are encountered that are detremental to the human face and a hinderance to eyesight. Accordingly, protective helmets are worn by the sportsman, characterized by a viewing window closed by a transparent shield that is partially and/or completely removable for access and ventilation. Race conditions vary from clear to inclement, with regard to temperature and debris, including wetness, carried by the wind. Therefore, ventilation may or may not be required dependant upon outside temperature, wind velocity, and the general condition of the atmosphere. For example, it may be desired that the shield be sealed at its periphery to the helmet window opening, or it may be desired to open the shield partially in order to prevent "fogging" as a result of the person's breathing. Or it may be desired to fully open the shield for access to the person's face for eye, nose and throat attention, all without removing the helmet from the person's head.

In view of the foregoing, there is a need for face shield control on helmets of the type under consideration, all of which has to do with the manner by which said shield is attached to the helmet, it being a general object of this invention to provide a positive control system that locks the shield tightly to the helmet window throughout the periphery of the seal.

It is also an object of this invention to provide a control system that releases the periphery of the shield from the seal for slight ventilation, and also to maintain substantially a half volume condition of air flow through the window.

And it is still another object of this invention to provide a control that establishes and maintains a fully open condition of the shield whereby the helmet window is unobstructed.

The shield as disclosed herein is secured in each of the aforementioned conditions by detent means incorporated in said control. In practice, the movement of the shield clears the normal external features of such a helmet, and is adapted to the helmet with a threaded anchor or insert. Control is by means of a single member in the form of a flat plate having a plurality of slots directing motion of and positioning the shield. In practice, the shield has a temple portion through which an opening receives and positions a spring member, and over which there is an operating member attached to the shield for its manipulated poistioning as may be required.

As shown and herein described, there are four basic postions and/or conditions of the shield: 1) a closed sealed condition excluding outside access and precluding entry of air into the helmet; 2) a forwardly shifted condition for slight ventilation to prevent fogging; 3) and a partially lifted condition for ventilation and free breathing; and 4) a lifted open condition for full access.

In carrying out this invetnion, the control features are applied to the left temple portion side of the helmet. However, it is to be understood that this face shield control can be applied to either or both sides of the helmet, a feature being its adequacy applied to one side only.

SUMMARY OF THE INVENTION

Racing helmets are a necessity in the prevention of head injury in the event of accidents, and complete enclosure of the head is the rule rather than the exception. Thus, full closure of the face is a requirement, with ventilation means provided in the helmet operative when subjected to high exterior air velocities as caused during race conditions. However, there are times when exterior air velocities subside. Therefore, shield control becomes an important factor in the well being and comfort of the helmet wearer, to control the inlet volume of the outside air, or to eliminate it, and for open access to the wearer's face. Herein, the face shield is characterized by a contoured transparent member formed to completly cover the window opening in the helmet. The face shield is pivotally carried by a pair of anchor fittings on a common axis at opposite temple portions of the helmet. Accordingly, the face shield can be lifted from the helmet window, or it can be dropped into a position coextensively covering said opening. A feature is the peripheral seal around the face shield where it is stopped against the window opening.

In carrying out this invention, the right side shield anchor rotates in a coaxial bearing opening in the shield, whereas the left side shield anchor slides as well as rotates in a detented control slot positioned in a shaped opening in the shield. A feature is the mulitplicity of control slots in a control member that limits fore and aft motion at the left side of the face shield, and to permit partial or complete lifting of the shield, all of which is controlled by detent means incorporated in the spring member, particularly a single control member Providing the multi functions enumerated above.

The foregoing and various other objects and features of this invention will be apparent and fully understood from the following detailed description of the typical preferred forms and applications thereof, throughout which description reference is made to the accompanying drawings.

THE DRAWINGS

Figure 6:
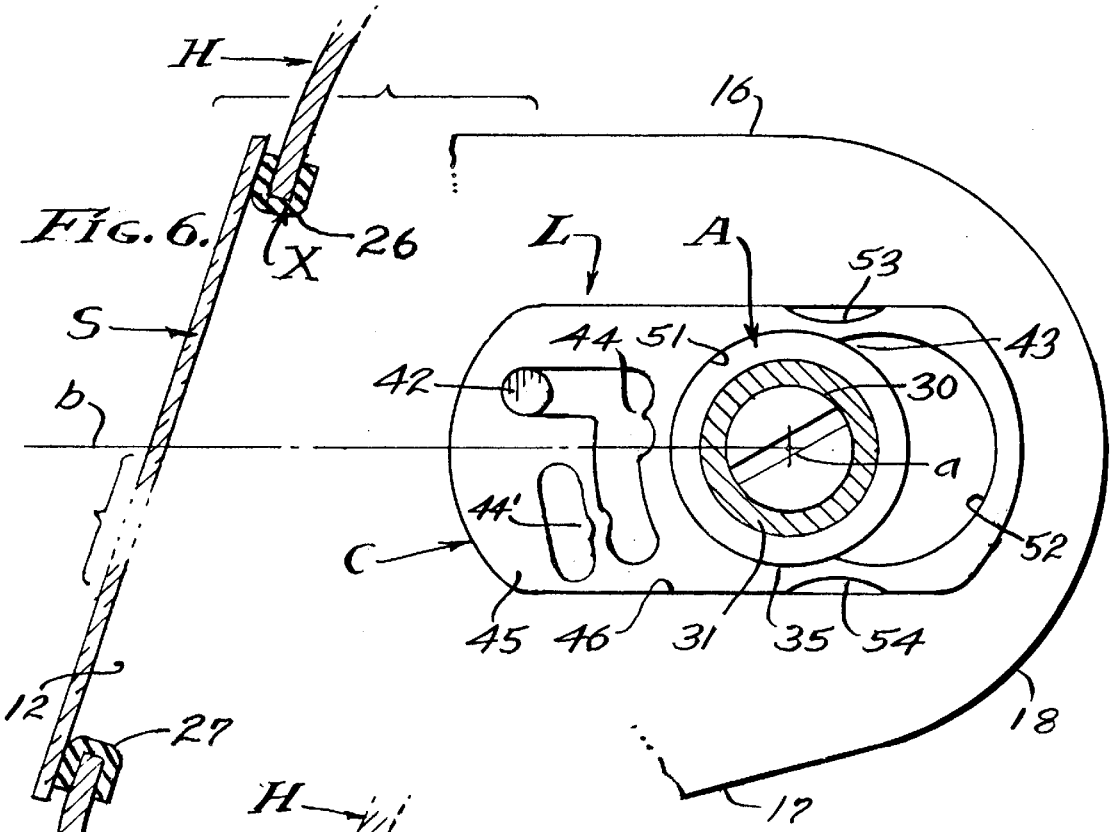
FIG. 6 is a view similar to FIG. 4 and with the lock lever removed to show the spring plate that characterizes this invention, the shield being in a closed locked position.
Figure 9:
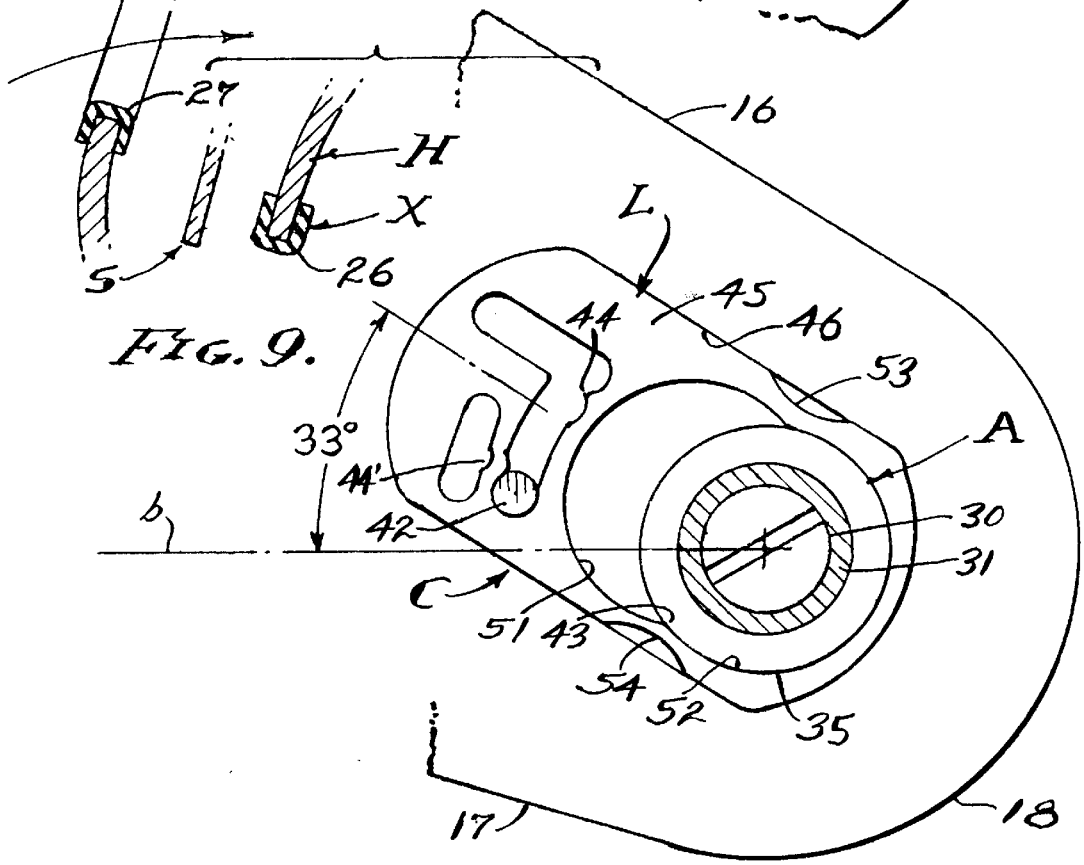

And, FIG. 9 is a view similar to FIG. 6, the shield being raised to clear the window opening of the helmet for full flow of air and complete access to the face of the wearer.

PREFERRED EMBODIMENT

Referring now to the drawings, there is a helmet H to which a face shield S is attached by the safety lock L of the present invention. The helmet is state of the art, in the form of a monocoque shell into which the head of a person is inserted through a neck opening surrounded by a collar 10. There is a vent openings 11 for normal in-use air circulation, and a window 12 opening forwardly between the right and left temple portions 13 and 14 of the helmet and below the forehead portion 15. The temple portions 13 and 14 are substantially planar and parallel one with the other at opposite sides of the helmet, although said portions may be concavo-convex depending upon helmet design. For all intents and purposes however, the temple portions are as stated and vertically disposed as shown. The forehead portion is slanted upwardly and rearwardly at approximately 15° as shown, the face shield S coinciding with said angle at the center of the helmet and turned into said vertical planes at the temple portions. It is to be understood that the helmet design features can vary. The helmet H per se is made of durable opaque material, whereas the face shield S is made of durable transparent material. Both members are of plastic and/or of a suitable composite meterial with safety as a priority and the shieldformed of an acrylic sheet meterial with optically flat surfaces.

Figure 1:
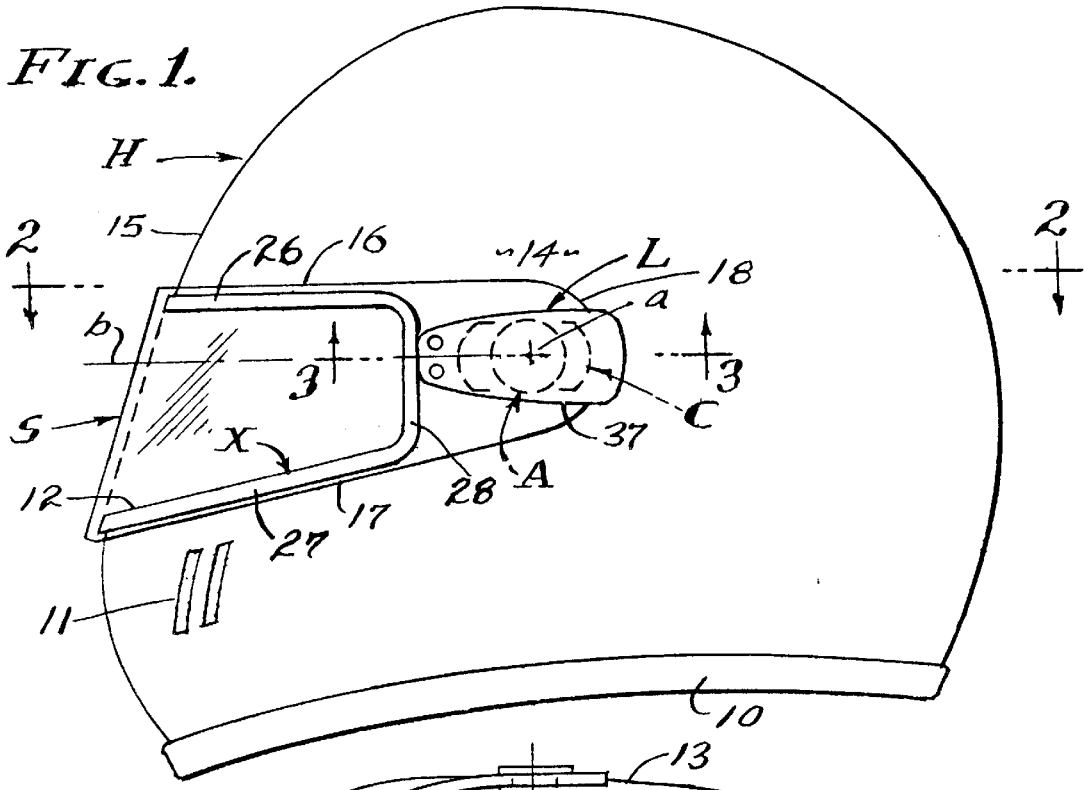
FIG. 1 is a side view of a helmet embodying the safety lock for its shield.
Figure 2:
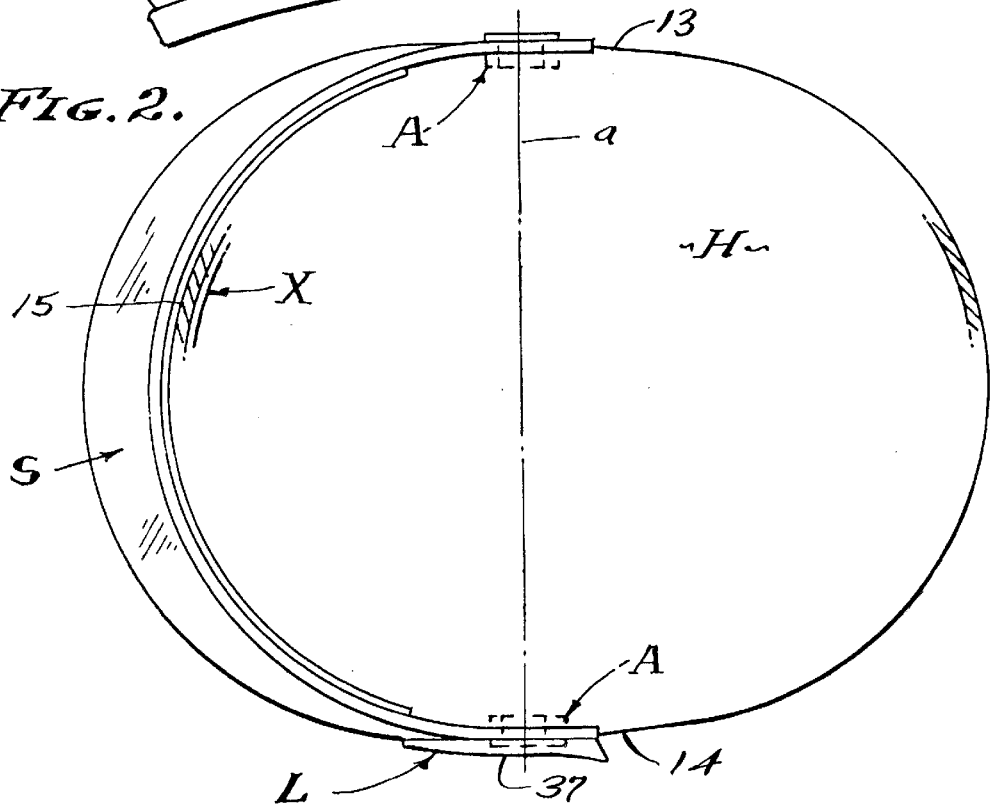
FIG. 2 is a plan view of the helmet and shield with the safety lock at one side thereof and taken as indicated by line 2—2 on FIG. 1.

In carrying out this invention, the shield S conforms to and complements the outside contours of the helmet H , having a top edge 16 uniformly at or spaced above the window 12, and having a bottom edge 17 uniformly at or spaced below said window. The helmet window 12 terminates forward of the temple portions 13 and 14, whereas the face shield S cantilevers rearwardly over said temple portions to overlie the same. A feature is the window seal X that surrounds the opening thereof and shown herein as a molded U-shaped cross sectioned elastomer member engaged over the inwardly disposed peripheral edges of said window, having continuous upper and lower edge portions 26 and 27 and a vertical rear edge portion 28. The seal is a flexible and depressible member of uniform cross section following the contour of the helmet and adapted to contiguously engage the inner face of the face shield when it is closed (see FIGS. 1, 2 and 6). In practice, the top and bottom edges 16 and 17 of the face shield are rearwardly convergent and joined by a convexly rounded back edge 18 centered on a pivot axis a extending transversely horizontal and normal to the planes of the temple portions 13 and 14. It is axis a over which the face shield S shifts longitudinally along a horizontal plane b coincidental with said axis for shutting off or for limited air circulation and about which it rotates so as to be raised for additional air circulation and for face access, all of which is controlled by the adjustable safety lock L as shown and hereinafter described.

Figure 3:
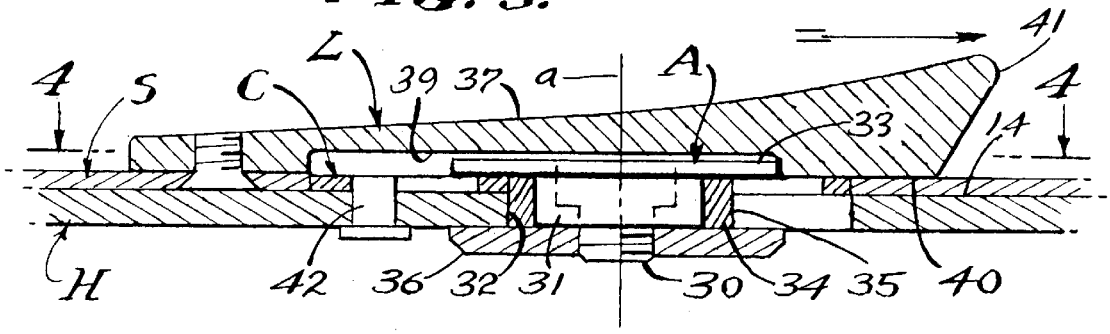
FIG. 3 is an enlarged sectional view of the safety lock taken as indicated by line 3—3 on FIG. 1.

The face shield S is pivotally secured to the helmet H on the axis a by means of retaining anchors A fastened to the opposite temple portions 13 and 14 by screw fasteners 30. That is, the right and left temple portions of the face shield are independently pivoted to the helmet on said axis a, a description of one anchor sufficing for both right and left installations thereof. As shown, each anchor A is a screw machine part comprised of a cylindrical body 31 with its outer diameter fixed into a bore 32 in the temple portions 13 and 14 of the helmet, and with a flange 33 to overlie and capture the face shield in working position (see FIG. 3). The left side of the helmet and shield combination is provided with the safety lock L that overlies and embraces the left side anchor A (see FIGS. 1 and 2). It is to be observed that a flange 33 overlies the face shield at both right and left temple portions, including the underlying control member C that characterizes this invention. Accordingly, the flanges 33 capture the face shield S in place at both temple portions of the helmet H. In order to accomodate variations in wall thickness of the helmet temple portions, a spacer 34 forms the outer diameter 35 of the anchor A and acts under compression between the flange 33 and a nut 36 to to receive the threaded screw fastener 30 (see FIGS. 3 and 5).

Figure 4:
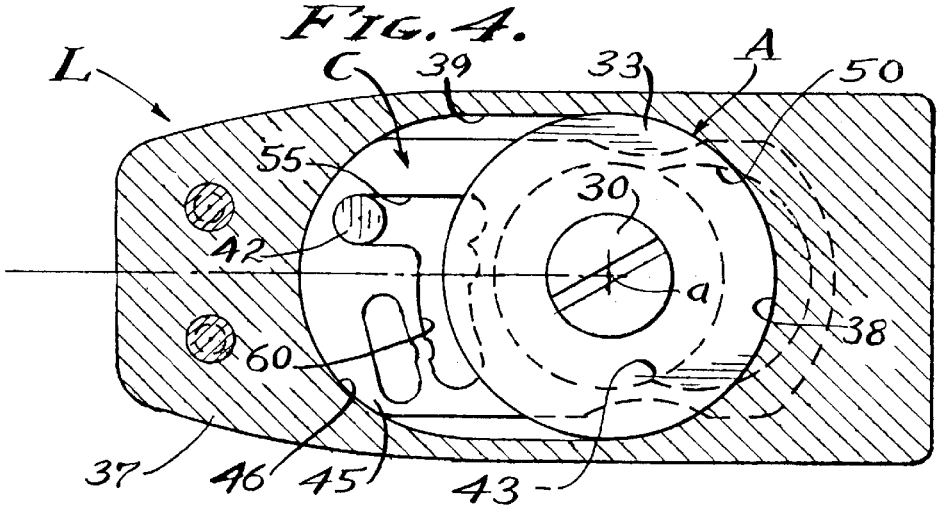
FIG. 4 is a side sectional view of the safety lock taken as indicated by line 4—4 on FIG. 3.
Figure 5:
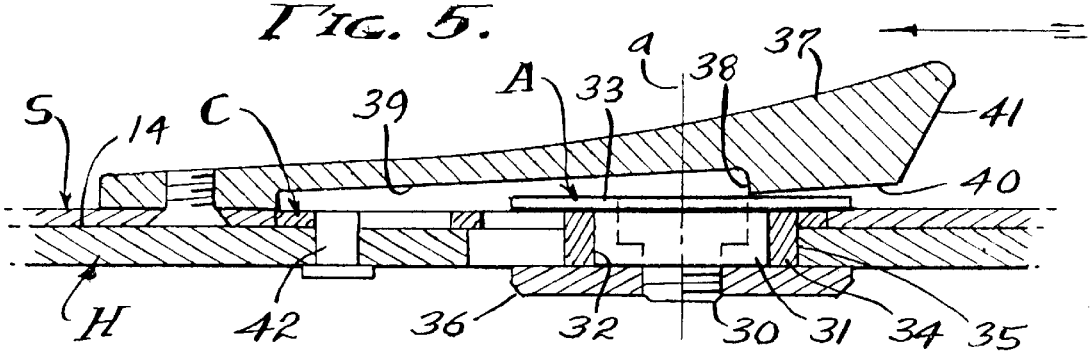
FIG. 5 is a view similar to FIG. 3 showing the safety lock in its released condition and the shield shifted forawrdly.
Figure 7:
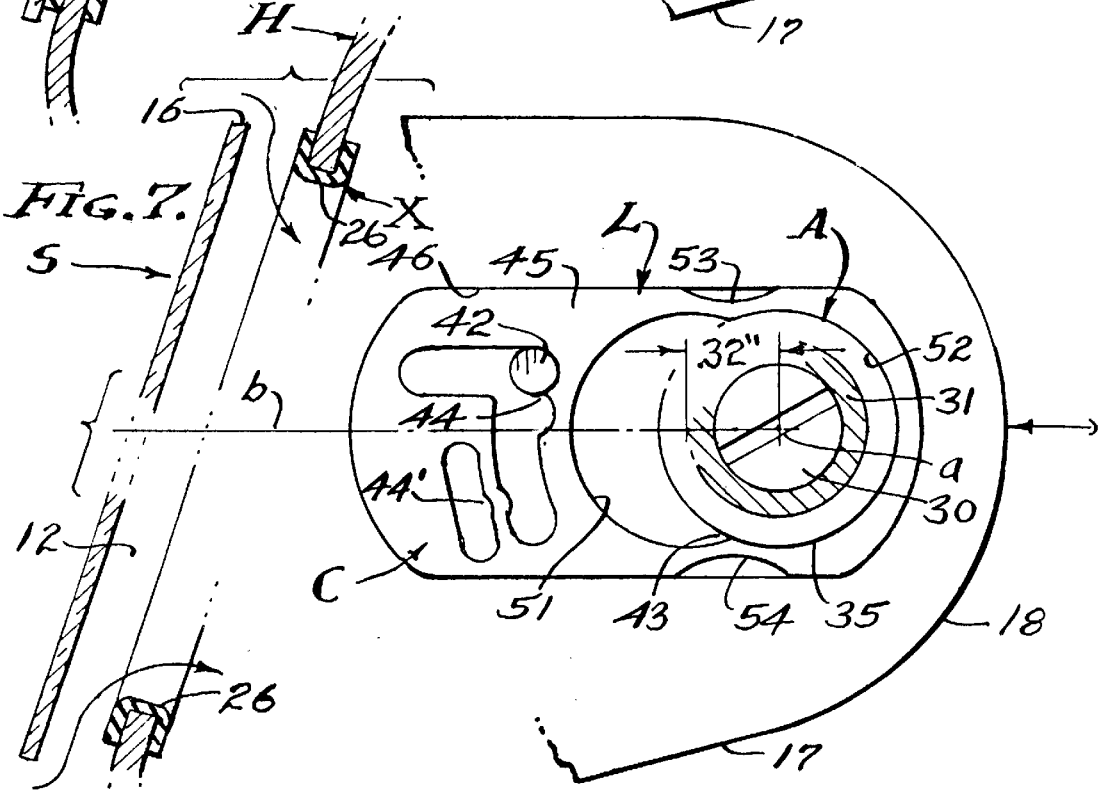
FIG. 7 is a view similar to FIG. 6, the shield being shifted forward into a venting position for limited air flow at the periphery of the shield.

Referring now to the safety lock L, a manually operable lever 37 is carried by the face shield S to releasably engage the anchor A fixedly postioned on the helmet H. The control means C later described permits longitudinal fore and aft movement of the shield relative to the helmet, the purpose of the safety lock being to secure the shield to the helmet in a tightly locked condition (see FIGS. 3 and 4). As shown, the lock lever 37 has a forwardly faced shoulder 38 that is releasably engageable with the back periphery of the anchor flange 33, when the face shield S is shifted rearwardly into a closed position. When the lever 37 is manually lifted as shown in FIG. 5 the shield and lever are free to move forward for limited air circulation as shown in FIG. 7). In practice, the lock lever is a flexible member of resilient material fixed to the left temple portion 14 of the face shield as by a pair of screw fasteners (or rivets). The underside of the lever has a pocket 39 that encloses the anchor flange 33 when the bottom face 40 of the lever is contiguously engaged with the temple portion of the face shield. The rear terminal free end of the lock lever 37 is formed with a lip 41 for finger engagement in order to facilitiate lifting of the lever to release the shoulder 38 from the anchor flange 33. The lock lever 37 automatically snaps back into a locked condition when manually positioning the face shield S as shown in FIGS. 1–4 and 6 of the drawings.

Referring now to the positioning control means C, the face shield S is constrained to follow predetermined movement patterns as follows: 1) the closed locked condition of FIG. 6; 2) the forwardly shifted condition of FIG. 7; 3) the partially lifted condition of FIG. 8; and 4) the fully lifted open condition of FIG. 9. As shown in FIG. 4, the lock lever 37 overlies a multiplicity of shield positioning slots formed and/or postioned in the temple portion of the face shield; a anchor positioning slot 50, a horizontal control slot 55, and a lift limiting slot 60. A positioning pin 42 is fixed to the temple portion 14 of the helmet and spaced forwardly of the pivot axis a, as shown throughout FIGS. 3–9. In accordance with this invention, the face shield S shifts fore and aft along a horizontal plane b of movement coincidental with the pivotal axis a. And, there is detent means 43 for positioning the anchor flange 33 in the slot 50, and there are detent means 44 and 44' for positioning the pin 42 in the slot 60.

In carrying out this invention, the pivot and control features are embodied in a plate member 45 through which the control slots 50, 55 and 60 are formed with resilient walls to establish said detent means. Accordingly, the plate 45 is made of resilient plastic material (0.045 in. thick), fitted into a complementary opening 46 through the temple portion of the face shield, so as to be rigidly positioned therein for controlling shield movement. The lock lever 37 overlies and conceals the aforementioned control means features, in both its extreme operative positions (see FIGS. 3–5).

Referring now to the closed locked condition of the face shield S and to FIGS. 1–4 and 6 of the drawings, the anchor positioning slot 50 is disposed on the horizontal plane b and comprised of two semi-circular adjoined openings 51 and 52, each to rotatably receive the outer diameter 35 of the anchor A, and on spaced centers (0.322 in. apart). Accordingly, there are front and back centers about which the pivot openings 51 and 52 are formed (see FIGS. 6 and 7), either of which is shifted to coincide with the aforesaid pivotal axis a. As clearly illustrated in FIG. 6, the openings 51 and 52 openly truncate each other at diametrically opposite points angularly disposed approximately 15° from said spaced centers of the two openings respectively, thereby establishing inwardly projecting and opposed detent lobes 53 and 54 positioned closer (0.625 in.) than the diameter 35 (0.700 in.) of anchor A. The material from which the plate member 45 is formed is resilient, the outer peripheral wall thickness at each detent lobe 53 and 54 being reduced to a desired thickness (0.050 in.) for a determined force required to resist shifting of the member 45 fore and aft over the anchor A. These two diametrically opposite wall sections are therefore springs that yield to motion of the plate 45 over the anchor A, and thereby positioning the plate on alternate centers of the slot 50.

Referring now to the forwardly shifted condition of the face shield S and to FIGS. 5 and 7 of the drawings, the horizontal control slot 55 is horizontally disposed parallel to plane b and is placed independantly of and forward of the slot 50 to slidably receive the positioning pin 42. The slots 50 and 55 are of equal length (a travel of 0.322 in.). Accordingly, the face shield S slides horizontally in a direction parallel with plane b, movement thereof being limited by slots 50 and 55. Note that the pin 42 is exposed to the depending slot 60 when the face shield is being held down by gravity and free to be lifted. It is in this forwardly shifted position that the face shield S is separated from the seal X at the top and bottom edges 16 and 17 thereof, so as to permit limited airflow into the helmet H as clearly shown in FIG. 7.

Figure 8:
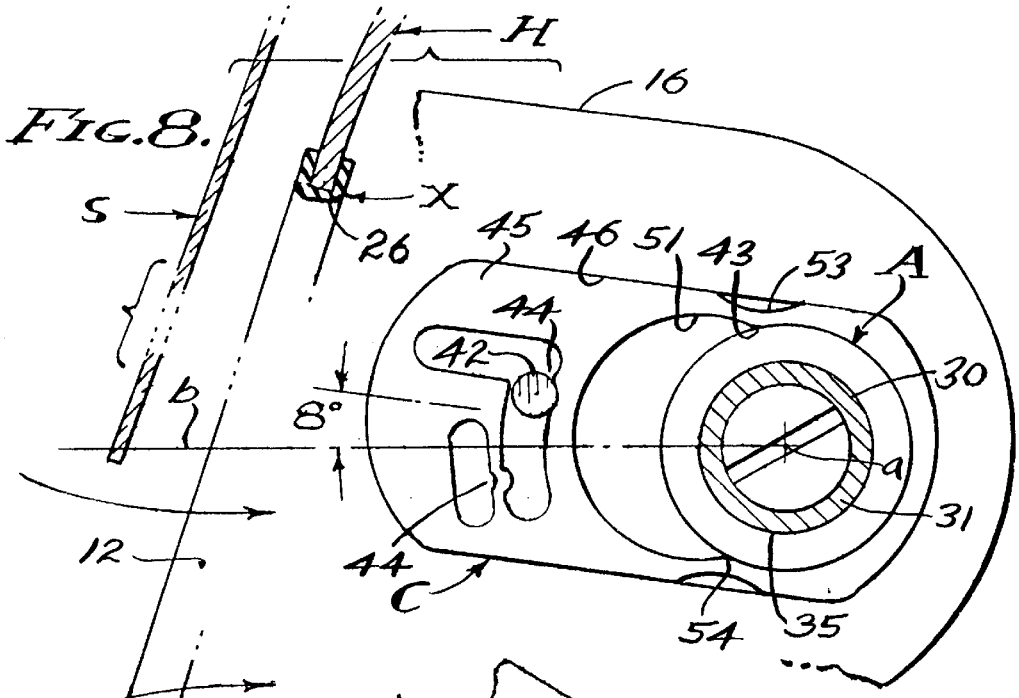
FIG. 8 is a view similar to FIG. 6, the shield being lifted from the FIG. 7 position for half opening flow of air beneath the lower edge of the shield.

Referring now to the partially lifted condition of face shield S and to FIG. 8 of the drawings, the lift limiting slot 60 formed in the plate 45 is arcuately disposed about the pivotal axis a of the helmet H and coincidental with the center of opening 52 that has shifted to axis a. Note that the axis of opening 51 has also shifted forwardly so as to be eccentric with respect to the now active pivotal axis a. The detent means 44 is formed at the inner wall of the slot 60 and angularly displaced from the plane of said slot (8°) in order to position the face shield S at an intermediate position as shown in FIG. 8. Accordingly, the lift limiting slot 60 is formed concentric with the axis of opening 52, so as to rotatably receive the positioning pin 42. The inner peripheral wall of slot 60 is adjacent the inner diameter wall of the opening 51 and its thickness reduced (0.050 in.) for a detemined force required to resist upwards shifting of the plate and shield. It is in this intermediate position that the bottom edge 17 of the face shield S is lifted to clear the bottom of the window 12 and thereby give the wearer generous air circulation while continuing to shield his face and protect his eyes.

Referring now to the fully lifted open condition of the face shield S and to FIG. 9 of the drawings, the lift limiting slot 60 hereinabove described is of an arcuate length to restrict the plate 45 and shield to approximately 33° of movement, as shown. Accordingly, the plate 45 is forwardly removed from the detent 44 for continued movement to the bottom end of the slot so as to engage over the detent 44' (see FIG. 9) at which position the face shield S clears the top edge of the helmet window 12. The outer peripheral wall of slot 60 is of reduced thickness by providing a clearance opening and with a raised detent lobe obstructing the slot 60 for a determined force required to resist downward displacement of the plate and shield. It is in this fully opened position that the wearer has complete access to his face.

Having described only the preferred forms and applications of my invention. I do not wish to be limited or restricted to the specific details herein set forth, but wish to reserve to myself any modifications or variations that may appear to those skilled in the art as set forth within the limits of the following claims.

I claim:

1. The combination of a safety lock and transparent face shield for a helmet having opposite side temple portions with a front window opening therebetween and an anchor at each side temple portion, each anchor having a back periphery; the combination comprising a transparent face shield to be carried by said anchors and complementary to the outside of the helmet for closing the window, and an anchor positioning slot in the face shield at one side temple portion and slidably engagable over one of said anchors, the anchor positioning slot being shiftable on said anchor between fore and aft positions, and a manually operable lever liftably carried by the face shield and having a shoulder releasably engagable with said back periphery of one of said anchors securing the face shield in the aft position closed against an outside of the helmet window and disengagable by manually lifting the lever for releasing the same to shift to the fore position for opening the window.

2. The combination of a safety lock and face shield as set forth in claim 1, wherein the anchor positioning slot in the face shield is comprised of spaced openly adjoining semicircular pivot openings with detent means therebetween.

3. The combination of a safety lock and face shield as set forth in claim 1, wherein the anchor positioning slot in the face shield is comprised of spaced openly adjoining semicircular pivot openings with detent means therebetween, one of said anchors being rotatable in either pivot opening and shiftable between said pivot openings.

4. The combination of a safety lock and face shield as set forth in claim 1, wherein the anchor positioning slot in the face shield is comprised of spaced openly adjacent semicircular pivot openings joined by resilient walls forming depressible detent means therebetween.

5. The combination of a safety lock and face shield as set forth in claim 1, wherein the face shield has temple portions contiguous to and slidable over the side temple portions of the helmet, and wherein the anchor positioning slot is formed in a plate member of resilient material inserted into one of said temple portions of the face shield.

6. The combination of a safety lock and face shield as set forth in claim 1, wherein the face shield has temple portions contiguous to and slidable over the side temple portions of the helmet, and wherein the anchor positioning slot is formed in a plate member of resilient material inserted into one of said temple portions of the shield and comprised of spaced openly adjacent semicircular pivot openings joined by resilient walls of said resilient material depressible as detent means between said pivot openings.

7. The combination of a positioning control and transparent face shield for a helmet having opposite side temple portions with a front window opening therebetween and an anchor at each temple portion and on a common horizontal axis normal to said temple portions, each anchor having a back periphery; the combination comprising a transparent face shield having opposite side temple portions contiguous to and adapted to overlie the aforesaid helmet temple portions and adapted to be pivotally carried on said anchors, at least one of said anchors being comprised of a body fixed to and projecting from one of said side temple portions of the helmet, and a flange overlying and retaining the overlying face shield temple portion of the helmet, an anchor positioning slot in said overlying side temple portion at one side of the face shield and slidably engagable over the body of said anchor, the anchor positioning slot being shiftable on said anchor between fore and aft positions, a positioning pin spaced forward from the anchor and fixed to and projecting from said one of said side temple portions of the helmet, a horizontal positioning slot in said overlying side temple portion of the face shield and slidably engagable over the positioning pin and of a length stopping the face shield in said aft position of the anchor positioning slot for closed engagement of the face shield against the helmet window or alternatively stopping the face shield forwardly in said fore position of the anchor positioning slot for limited opening of the helmet for airflow therethrough, and a manually operable lever liftably carried by the face shield and having a shoulder releasably engagable with said back periphery of the anchor securing the face shield in the aft position closed against an outside of the helmet window and disengagable by manually lifting the lever for releasing the same to shift to the fore position for opening the window.

8. The combination of a positioning control and face shield as set forth in claim 7, wherein the anchor positioning slot in the face shield is comprised of spaced openly adjoining openings with detent means therebetween, one of said anchors being shiftable between said openings.

9. The combination of a positioning control and face shield as set forth in claim 7, wherein the anchor positioning slot in the face shield is comprised of spaced openly adjacent openings joined by resilient walls forming depressible detent means therebetween.

10. The combination of a positioning control and face shield as set forth in claim 7, wherein the face shield has temple portions contiguous to and slidable over the side temple portions of the helmet, and wherein the anchor positioning slot is formed in a plate member of resilient material inserted into one of said temple portions of the shield.

11. The combination of a positioning control and face shield as set forth in claim 7, wherein the face shield has temple portions contiguous to and slidable over the side temple portions of the helmet, and wherein the anchor positioning slot is formed in a plate member of resilient material inserted into one of said temple portions of the shield and comprised of spaced openly adjacent openings joined by resilient walls of said resilient material depressible as detent means between said openings.

12. The combination of a transparent face shield and face shield positioning control for a helmet having opposite side temple portions with a front window opening therebetween and an anchor pivot at each temple portion and on a common horizontal axis normal to said temple portions, each anchor having a back periphery; the combination comprising a transparent face shield having opposite side temple portions contiguous to and adapted to overlie the aforesaid helmet temple portions and adapted to be pivotally carried on said anchor pivots, at least one of said anchor pivots being comprised of a cylindrical body fixed to and projecting from one of said side temple portions of the helmet, and a flange overlying and retaining the overlying face shield temple portion of the helmet, an anchor positioning slot in said overlying side temple portion at one side of the face shield and slidably engagable over the cylindrical body of said anchor pivot, the anchor positioning slot being shiftable on said anchor pivot between fore and aft positions, a positioning pin spaced forward from the anchor and fixed to and projecting from one of said side temple portions of the helmet, a horizontal control slot extending forwardly in said overlying side temple portion of the face shield and slidably engaged over the positioning pin and of a length stopping the face shield in aid aft position of the anchor positioning slot for closed engagement of the face shield against the helmet window or alternatively stopping the face shield forwardly in said fore position of the anchor positioning slot for limited opening of the helmet for airflow therethrough, a lift limiting slot in said overlying side temple portion of the face shield and extending downward from a back end of the horizontal control slot when in said alternate stopped fore position thereof and adapted to slidably receive the positioning pin and of a length to limit lifting of the face shield, and a manually operable liftable lever carried by the face shield and having a shoulder releasably engagable with said back periphery of the anchor securing the face shield in the aft position closed against an outside of the helmet window and disengaged by manually lifting the lever for releasing the same to shift to the fore position for opening the window.

13. The combination of a positioning control and face shield as set forth in claim 12, wherein the lift limiting slot in the face shield is arcuately disposed about a center of the cylindrical body of the anchor pivot when in said alternate stopped fore position.

14. The combination of a positioning control and face shield as set forth in claim 12, there being detent means for securing lifted positioning of the positioning pin in the left limiting slot.

15. The combination of a positioning control and face shield as set forth in claim 13, there being detent means for securing intermediate lifted positioning of the positioning pin in the lift limiting slot.

16. The combination of a positioning control and face shield as set forth in claim 13, there being detent means for securing fully lifted positioning of the positioning pin in the lift limiting slot.

17. The combination of a positioning control and face shield as set forth in claim 14, wherein the detent means is comprised of resilient walls of the lift limiting slot with depressible obstructions releasably securing the positioning pin.

* * * * *